United States Patent [19]

Messler et al.

[11] 4,123,825

[45] Nov. 7, 1978

[54] TUFTING BUTTON WITH PLASTIC COLLET

[75] Inventors: Frederick B. Messler, Manhattan Beach; Donald Neville, Malibu, both of Calif.

[73] Assignee: Plastiglide Manufacturing Corporation, Hawthorne, Calif.

[21] Appl. No.: 846,516

[22] Filed: Oct. 28, 1977

[51] Int. Cl.[2] ..... A44B 1/18; A44B 13/00

[52] U.S. Cl. ..... 24/90 B; 24/230.5 TP; 5/356

[58] Field of Search ..... 24/90 B; 5/356; 24/230.5 TP, 102 T

[56] References Cited

U.S. PATENT DOCUMENTS

| | | | |
|---|---|---|---|
| 3,829,935 | 8/1974 | Critchfield | 24/90 B |
| 3,879,807 | 4/1975 | Casale | 24/230.5 TP |
| 3,972,093 | 8/1976 | Aimar | 24/90 B |
| 4,012,812 | 3/1977 | Black | 24/90 B |

FOREIGN PATENT DOCUMENTS

| | | | |
|---|---|---|---|
| 974,670 | 9/1975 | Canada | 24/90 B |

*Primary Examiner*—Bernard A. Gelak

*Attorney, Agent, or Firm*—Charles H. Schwartz

[57] ABSTRACT

A plastic collet for locking fabric around a shell member and with the plastic collet including a base portion for insertion into the open end of the shell member for locking fabric around the shell member, a hook portion extending from the base portion and with the hook portion including an eye extending through the hook portion for receiving a string member, an elongated lead-in ramp extending from the exterior of the hook to the eye for providing a passageway for a string member, the lead-in ramp formed with an open area adjacent the exterior of the hook for providing easy access to an elongated restricted area leading into the eye and with the restricted area formed between the body of the hook portion and a lever section extending from the base portion and with the lever section flexible to move forward the base portion as the string is pulled through the restricted area and with the lever section snapping back to its initial position when the string is pulled into the eye, and the eye of the hook having a configuration substantially coextensive with the outer configuration of the string.

9 Claims, 8 Drawing Figures

FIG. 1
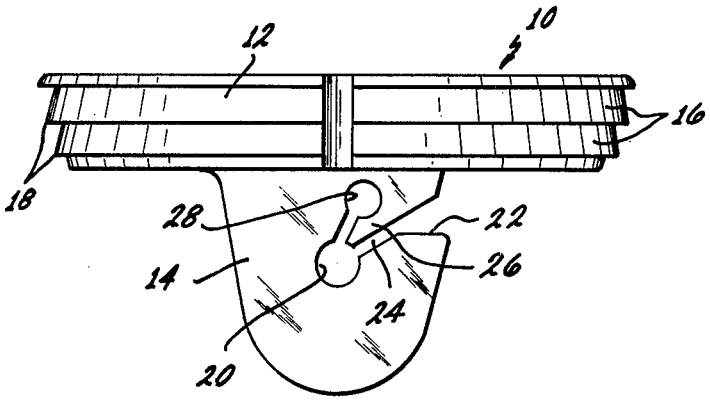
FIG. 2
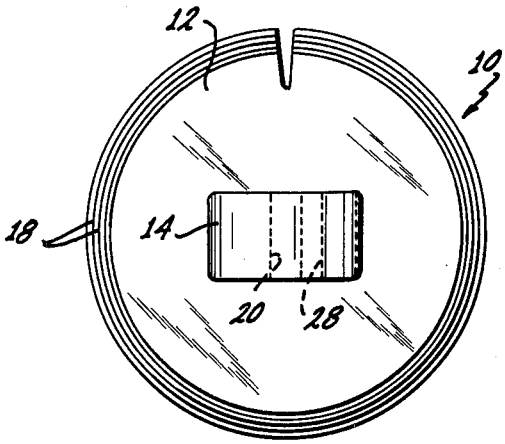
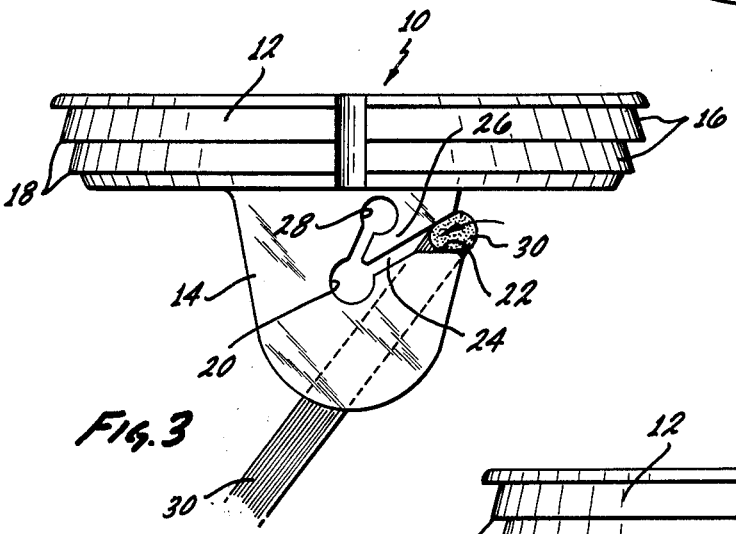
FIG. 3
FIG. 4
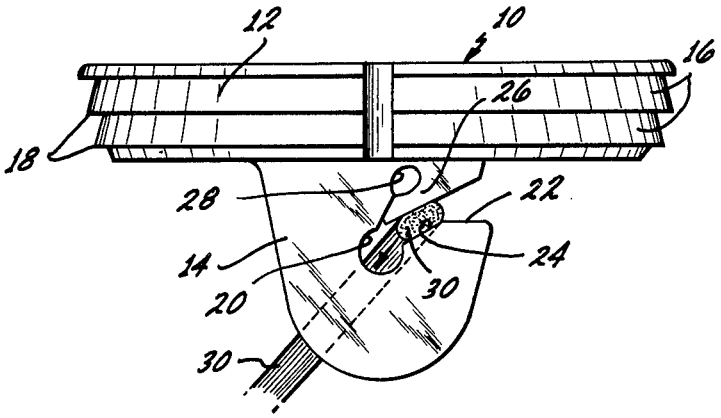

TUFTING BUTTON WITH PLASTIC COLLET

The present invention relates to an improved tufting button for use in the upholstery field. Specifically, the invention relates to an improved plastic collet for the tufting button.

In a particular type of tufting button used in the upholstery field, the button includes a metal shell which supports a piece of upholstery material and a plastic collet which is pressed into the open end of the shell portion and against the end of the piece of upholstery material so as to stretch and lock the upholstery material tightly over the metal shell. Extending from the base portion of the plastic collet in a direction away from the metal shell is a hook portion which is used to receive a tufting loop or string. As an example, a pair of such tufting buttons may be used with a loop or string extending between the pair of tufting buttons. The buttons are positioned on either side of a pillow with the string extending there between so as to have a tufting button on either side of the pillow. As an alternataive, the loop may be secured to an interior portion of the upholstered piece of furniture and with a single tufting button positioned on the exterior of the upholstery of the upholstered piece of furniture.

In the past, a number of specific structures have been used to provide for tufting buttons and specifically to provide for the securing of the plastic collet within the metal shell so as to stretch and lock the upholstery material in position over the metal shell. In addition, the prior art tufting buttons have used various configurations for the hook portion so as to prevent the loop or string from working out of the eye of the hook. A specific example of such a tufting button may be seen with reference to U.S. Pat. No. 3,829,935 issued Aug. 20, 1974, and listing Jack G. Critchfield as the inventor.

The present invention is directed to a tufting button which has a number of improvements over the prior art tufting buttons. Specifically, the present invention provides for a hook structure extending from the base of the plastic collet which hook has a lower profile than the prior art tufting buttons, and which lower profile provides for certain advantages. Specifically, the use of a lower profile does not deform the upholstered portion of the furniture to which the tufting button is applied as much as the prior art tufting buttons. Also, the provisions of a lower profile for the hook portion allows the tufting button of the present invention to be used on thinner cushions than prior art tufting buttons.

The specific structure for the hook portion of the tufting button of the present invention includes an elongated lead-in ramp section to provide for an easy access to the eye of the hook for the loop or string. The loop or string may be pulled into the eye of the hook portion by a substantially straight down motion. A flexible lever section is adjacent to the ramp and the lever section is flexed as the string is pulled along the ramp so as to allow for the passage of the string to the eye of the hook. When the string is pulled into position within the eye of the hook, the lever section snaps back to lock the string in position within the eye. This lever section acts as a latch or leaf spring to provide for a positive locking of the string in position within the eye of the hook.

Once the string is in position within the eye of the hook, it is retained in position since the eye has a dimension substantially coextensive with the outer configuration of the string. This holds the string in position within the eye by providing a relatively high contact area between the eye of the hook and the outer surface of the string. Therefore, once the string is locked in position within the eye, the string tends to remain in this position so as to prevent abrasion by movement between the string and the eye of the hook. The prior art tufting buttons normally have a relatively larger opening for the eye so that the string can move around within this opening to thereby produce abrasion between the string and the eye. Ultimately the string may break because of the rubbing of the string in the eye.

The present invention also provides for an improved structure for the portion of the plastic collet which secures the upholstery fabric within the open end of the metal shell. Specifically, the present invention includes a series of serrations which extend outwardly and around the circumference of the base of the plastic collet so as to provide for sharp corners to grip the fabric and thereby lock the end of the fabric within the metal shell. If the metal shell portion, including the fabric is pulled in a direction away from the plastic collet, this griping action tends to act like a fish hook to dig into the fabric and lock the fabric tightly in position.

The present invention thereby provides for an improved tufting button including a plastic collet having an improved hook portion and an improved base portion so as to securely lock a string or loop in position and also to securely grip an upholstery fabric as the plastic collet is inserted into the open end of the metal shell.

A clearer understanding of the invention will be had with reference to the following description and drawings wherein:

FIG. 1 illustrates a side view of a plastic collet for use with a tufting button of the present invention;

FIG. 2 illustrates a bottom view of the plastic collet of FIG. 1;

FIG. 3 illustrates the plastic collet of FIG. 1 showing the introduction of a string or loop;

FIG. 4 illustrates the plastic collet of FIG. 1 showing the string almost pulled into the eye of the hook;

Figure 5:
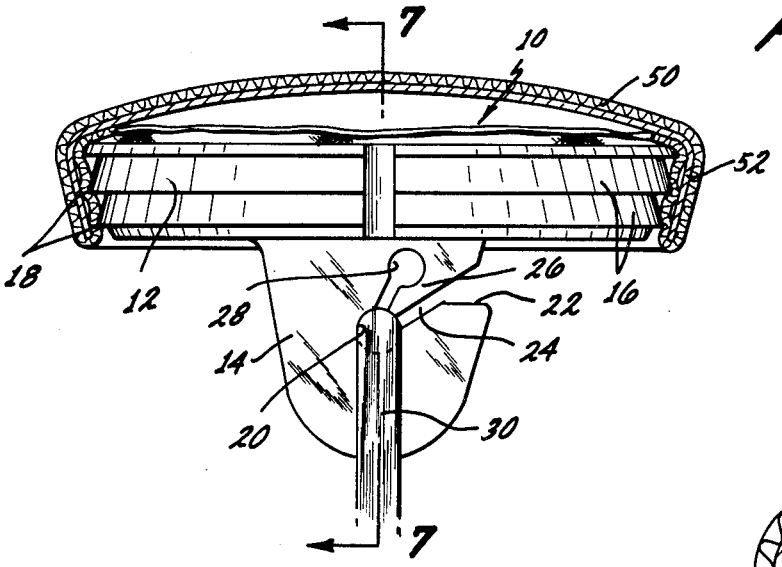
FIG. 5 illustrates a complete tufting button showing the string in position within the eye of the hook and showing the plastic collet griping the end of the fabric and supported over a metal shell.

In FIG. 1 a plastic collet 10 is shown to be formed from a base portion 12 and a hook portion 14. The base portion 12 includes a plurality of circumferential serrations 16 which extend downwardly and outwardly so as to form sharp corners 18 which are used to grip upholstery fabric in a manner described in a later portion of this specification.

Extending from the base portion 12 is the hook portion 14. The hook portion 14 includes an eye 20 which receives a loop or string and with an entrance to the eye 20 provided by an elongated lead-in ramp 22. It can be seen that the lead-in ramp portion 22 narrows substantially in the area 24. The ramp 22 including the narrowed area 24 is formed between the main body of the hook 14 and a lever arm section 26. The lever arm section 26 extends from the base portion 12 and is relatively flexible compared to the body of the hook 14 adjacent the narrowed area 24 due to a cutout section 28.

FIG. 2 illustrates a bottom view of the plastic collet 10 of FIG. 1 and it can be seen from FIG. 2 that the hook portion 14 extends from the central area of the base 12 of the plastic collet 10.

FIG. 3 illustrates the plastic collet 10 of FIG. 1 and specifically illustrates a loop or strip 30 as it is initially positioned within the open end of the lead-in ramp 22. It can be seen that the open end of the lead-in ramp 22 provides a relatively easy access for the string 30 so that the string 30 can be pulled in a relatively downward direction to start to pull the string 30 into the restricted area 24 of the ramp 22.

FIG. 4 illustrates the plastic collet 10 with the string 30 pulled partially through the restricted area 24 of the ramp 22. It can be seen in FIG. 4 that the thickness of the string 30 as it is being pulled through the restricted area 24 forces the lever section 26 to be rotated in a direction away from the restricted area 24. The cutout portion 28 increases the flexibility of the lever section 26 to facilitate this rotation of the level section 26 away from the restricted area 24.

The lever section 26 actually operates as a leaf spring and will ultimately latch to the position shown in FIG. 3 to lock the string in position within the eye 20. Specifically, this can be seen in FIG. 5 where the string 30 is shown to have been pulled through the restricted area 24 to be within the eye 20 of the hook. The lever section 26 has snapped back to its original position to lock the string in position. Because the end portion of the lever section 26 adjacent the string 30 has relatively sharp corners, this additionally helps to prevent the string 30 from working out of the eye 20.

In addition, it can be seen that the configuration of the eye 20 in association with the end portion of the lever section 26 forms a substantially round configuration and has substantially the same diameter as that of the string 30. This provides for a relatively high amount of surface contact between the string 30 and the eye 20 and end portion of the lever section 26. This tends to lock the string 30 in position within the eye 20 and prevents the string from moving within the eye 20. This is desirable since the movement of the string within the eye tends to cause abrasion which ultimately provides for breakage of the string.

As indicated above, once the string 30 is pulled into the eye, the lever section 26, because it acts as a leaf spring, snaps back downward like a latching mechamism and locks the string within the eye 20. It can also be seen that it will be relatively difficult to pull the string out of the eye because of the sharp corners at the end of the lever section 26 and also because of the restricted size of the passageway 24. Specifically, the string would have to be pulled at exactly the right angle and direction in order to pull the string out of the eye 20 and through the restricted area 24.

FIG. 5 also shows the plastic collet 10 locking upholstery fabric 50 around metal shell 52 through the open end of the metal shell 52. Specifically, a small piece of the upholstery fabric 50 is folded around the metal shell 52 and the plastic collet is inserted into the open end and is forced to the position shown in FIG. 5 so as to lock the fabric in position. At the same time the fabric is locked in position, the fabric is also stretched over the metal shell 52.

Figure 6:
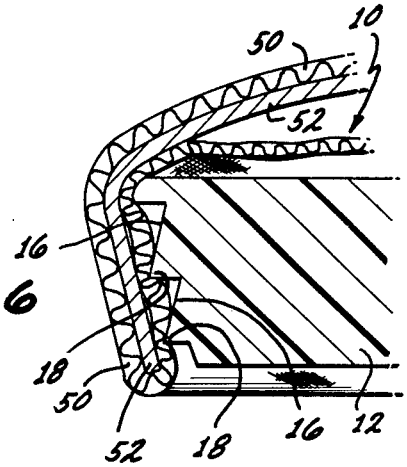
FIG. 6 illustrates a detail of the tufting button of FIG. 5 showing the griping of the fabric by the serrated portion of the plastic collet.

FIG. 6 illustrates in detail the locking of the fabric 50 over the metal shell 52 using the plastic collet 10. Specifically, it can be seen in FIG. 6 that the serrations 16 which extend around the circumference of the base portion 12 extend outwardly and downwardly to form the sharply pointed edges 18. These pointed edges 18 act as fish hooks or barbs since they form an acute angle which tends to dig into the fabric 50. If the fabric 50 and shell 52 are pulled in a direction away from the plastic collet 10, the pointed edges 18 will further dig into the fabric to further lock the fabric in position.

Figure 7:
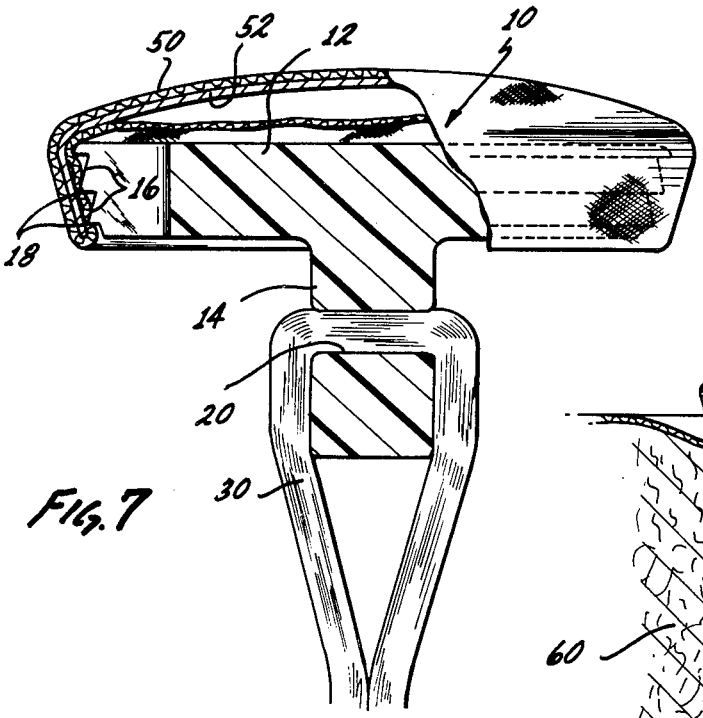
FIG. 7 illustrates a view of the tufting button of FIG. 5 taken along lines 7—7.
Figure 8:
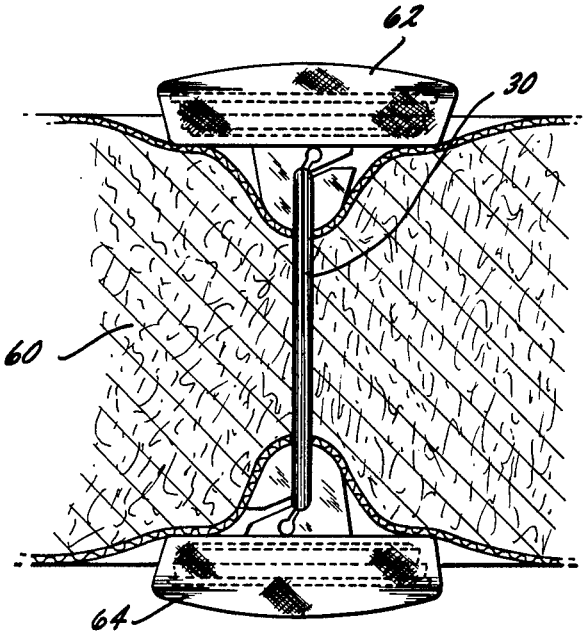
FIG. 8 illustrates a pair of tufting buttons shown on either side of a pillow and interconnected by a string loop.

FIG. 7 illustrates a cross-sectional view of the tufting button of FIG. 5 showing the position of the string or loop 30 extending through the eye 20 and looping down and away from the tufting button. The loop 30 may then be anchored to an interior portion of the upholstered piece of furniture, or a pair of such tufting buttons may be positioned on either side of a pillow with the loop 30 extending between these tufting buttons. This can be seen, for example, in FIG. 8 wherein a pillow 60 includes a pair of tufting buttons 62 and 64, each of which has an identical construction to the tufting button shown in FIG. 5. As can be seen in FIG. 8, loop 30 extends between the tufting buttons 62 and 64 to lock the tufting buttons on either side of the pillow 60.

The tufting button of the present invention, such as shown in FIG. 5, has a relatively low profile in that the hook portion 14 does not extend a substantial distance from the base portion 12. Because of this low profile, the tufting button of the present invention does not deform the surrounding upholstery fabric as much as prior art tufting buttons. Specifically, the shorter the distance by which the hook presses into the surrounding upholstery, the smaller the amount of distortion of the surrounding area of fabric. This can be clearly seen in FIG. 8 wherein the hook portions of the tufting buttons press against the outer fabric of the pillow 60. The shorter the distance between the end of the hook 14 and the bottom of the base portion 12, the less the tufting button deforms the surrounding fabric. In addition, the lower the profile of the hook portion of the tufting button, then the thinner the pillow on which a pair of tufting buttons can be used. For example, as shown in FIG. 8, the pillow 60 may be thinner than prior art pillows with tufting buttons and still allow for ample distance between the tufting buttons 62 and 64.

The present invention has therefore been described with reference to an improved tufting button which provides for a secure locking of the upholstery fabric around the metal shell by a plastic collet. The plastic collet includes serrated edges to enhance this locking of the upholstery fabric. Additionally a hook portion of the plastic collet provides for a secure locking of the loop or string which passes into the eye of the hook portion. Also, the profile of the tufting button of the present invention is relatively low so as to provide for a reduced distortion of the surrounding upholstery fabric.

Although the invention has been described with reference to a particular embodiment, it is to be appreciated that the various adaptations and modifications may be made and the invention is only to be limited by the appended claims.

We claim:

1. A plastic collet for locking fabric around a shell member and with the plastic collet including a base portion for insertion into the open end of the shell member for locking fabric around the shell member, a hook portion extending from the base portion and with the hook portion including a generally circular eye extending through the hook portion for receiving a string member, an elongated lead-in ramp extending from the exterior of the hook to the eye for providing a passageway for a string member, the lead-in ramp formed with a flared intrance adjacent the exterior of the hook for providing easy access to an elongated restricted area leading into the eye and with the restricted area formed between the body of the hook portion and a lever section extending from the base portion towards the center portion of said eye terminating at an interior end and with the lever section flexible to move toward the base portion as the string is pulled through the restricted area and with the lever section snapping back to its initial position when the string is pulled into the eye and with the body of the hook portion substantially rigid to resist movement as the string is pulled through the restricted area, and the eye of the hook including said interior end of the lever section having a configuration substantially coextensive with said eye and forming a portion thereof, at least a portion of the lever section being relieved thereby forming a reduced portion to increase the flexibility of the lever section.

2. The plastic collet of claim 1 wherein the interior end of the lever section includes sharp corners to resist the string reentering the restricted area.

3. The plastic collet of claim 1 wherein the hook portion has a low profile compared to the overall height of the tufting button.

4. The plastic collet of claim 1 wherein the base portion includes circumferential serrations extending downwardly toward the hook portion and outwardly from the base portion and with the sides of the serrations forming an actue angle.

5. A collet for use as a part of a tufting button including a string, a circular base portion, a hook portion extending from the circular base portion from a center area of the base portion, the hook portion divided into a substantially rigid main body and a flexible lever section adjacent to a portion of the main body and forming an elongated lead-in ramp having a restricted dimension, said flexible lever section having an interior end, a generally circular eye extending through the hook and located at the end of the lead-in ramp and with the lead-in ramp forming a passageway for said string having an outer dimension greater than the dimension of the restricted dimension of the lead-in ramp and with the lever section flexing away from the main body of the hook and toward the base as the string is pulled through the lead-in ramp and with the lever section flexing back to its initial position as the string is pulled into the eye and with the substantially rigid main body resisting movement as the string is pulled into the eye, and the eye of the hook includes said interior end of the lever section as part of the eye and with the eye coextensive in size and configuration with the outer configuration of the string for locking the string in position within the eye of the hook.

6. The collet of claim 5 wherein a portion of the lever section is relieved to increase the flexibility of the lever section.

7. The collet of claim 5 wherein the end of the lever section includes sharp corners to resist the string reentering the restricted area.

8. The collet of claim 5 wherein the hook portion has a low profile compared to the overall height of the tufting button.

9. The collet of claim 5 wherein the base portion includes circumferential serrations extending downwardly toward the hook portion and outwardly from the base portion and with the sides of the serrations forming an acute angle.

* * * * *